US010842233B1

(12) United States Patent
Sotis et al.

(10) Patent No.: US 10,842,233 B1
(45) Date of Patent: Nov. 24, 2020

(54) STRENGTH TRAINING WITH HAND HOLD STRAP ADJUSTMENT DEVICE

(71) Applicant: Prism Fitness, Inc., Verona, WI (US)

(72) Inventors: William J. Sotis, Fitchburg, WI (US); Weng Kin Chen, Shanghai (CN)

(73) Assignee: PRISM FITNESS, INC., Verona, WI (US)

( * ) Notice: Subject to any disclaimer, the term of this patent is extended or adjusted under 35 U.S.C. 154(b) by 52 days.

(21) Appl. No.: 16/289,264

(22) Filed: Feb. 28, 2019

Related U.S. Application Data

(60) Provisional application No. 62/637,241, filed on Mar. 1, 2018.

(51) Int. Cl.

| | |
|---|---|
| ***A44B 11/25*** | (2006.01) |
| ***A63B 21/00*** | (2006.01) |
| ***A63B 21/002*** | (2006.01) |
| *A44B 11/06* | (2006.01) |
| *A63B 7/00* | (2006.01) |
| *A63B 7/02* | (2006.01) |

(52) U.S. Cl.
CPC ..... *A44B 11/2557* (2013.01); *A63B 21/0023* (2013.01); *A63B 21/151* (2013.01); *A63B 21/4035* (2015.10); *A44B 11/06* (2013.01); *A63B 7/00* (2013.01); *A63B 7/02* (2013.01)

(58) Field of Classification Search
CPC ... A44B 11/2557; A44B 11/06; A44B 11/065; A44B 11/10; A44B 11/2561; Y10T 24/4019; Y10T 24/4079; Y10T 24/4084; A63B 21/0023; A63B 21/151; A63B 21/4035; A63B 7/00; A63B 7/02
See application file for complete search history.

(56) References Cited

U.S. PATENT DOCUMENTS

| | | | | |
|---|---|---|---|---|
| 3,163,905 | A | 1/1965 | Gaylord | |
| 5,170,539 | A | 12/1992 | Lundstedt et al. | |
| 5,350,195 | A | 9/1994 | Brown | |
| 5,471,717 | A * | 12/1995 | Ennerdal | A44B 11/2557 24/633 |
| 6,547,218 | B2 | 4/2003 | Landy | |
| 6,877,189 | B2 | 4/2005 | Simonson et al. | |
| 6,941,620 | B1 | 9/2005 | Hinds | |
| 7,044,896 | B2 | 5/2006 | Hetrick | |
| 7,651,448 | B2 | 1/2010 | Hetrick | |
| 7,722,508 | B2 | 5/2010 | Hetrick | |
| 7,762,932 | B2 | 7/2010 | Hetrick | |

(Continued)

*Primary Examiner* — Megan Anderson
(74) *Attorney, Agent, or Firm* — Stiennon & Stiennon

(57) ABSTRACT

A mechanism for adjusting the length of two straps making up a strength trainer of the type having a hand or foothold connected to a first strap and a second anchored strap. The mechanism has a rectangular ring mounted to move through a cross member engaged with a housing by a spring extended between the ring and the housing. A first strap is looped around a first member of the ring, while the second strap passes thought the ring below an opposite member and wrapping the cross member to pass through the ring a second time after passing between the opposite member of the ring and the second member so as to engage two high friction surfaces on the cross member and one on the ring. Adjustment is by rotating the housing and ring to be perpendicular to the load to unload the second strap from the high friction surfaces.

20 Claims, 4 Drawing Sheets

(56) References Cited

U.S. PATENT DOCUMENTS

| | | | | |
|---|---|---|---|---|
| 7,785,244 | B2 | 8/2010 | Hetrick | |
| 7,806,814 | B2 | 10/2010 | Hetrick | |
| D636,036 | S | 4/2011 | Rios | |
| 8,043,197 | B2 | 10/2011 | Hetrick | |
| 8,083,653 | B2 | 12/2011 | Hetrick | |
| 8,088,053 | B2 | 1/2012 | Whyatt et al. | |
| D669,945 | S | 10/2012 | Russo et al. | |
| 8,678,983 | B1 * | 3/2014 | Brown | A63B 21/068 482/91 |
| 8,840,532 | B2 | 9/2014 | Hetrick et al. | |
| 8,979,716 | B1 * | 3/2015 | Rawlins | A63B 21/0442 482/91 |
| 9,345,922 | B2 * | 5/2016 | Allison | A63B 21/4035 |
| 9,433,258 | B2 | 9/2016 | Hetrick et al. | |
| D808,251 | S | 1/2018 | Hetrick et al. | |
| 10,611,334 | B2 * | 4/2020 | Eaton | B60R 22/206 |
| 2011/0124477 | A1 | 5/2011 | Davis | |
| 2012/0329620 | A1 * | 12/2012 | White | A63B 7/02 482/131 |
| 2013/0143724 | A1 | 6/2013 | DeMeo | |
| 2013/0217547 | A1 | 8/2013 | Hinds et al. | |
| 2014/0274569 | A1 | 9/2014 | Lewen | |
| 2016/0199683 | A1 * | 7/2016 | Shamlin | A63B 21/4015 482/130 |
| 2017/0361150 | A1 * | 12/2017 | Polinsky | A63B 21/16 |

* cited by examiner 42
72
73
72
72
74
60
72
28
63
44
65

48
30
42
72
48
52
32
26
73
22
56
25
32
49
49
62
64
64

STRENGTH TRAINING WITH HAND HOLD STRAP ADJUSTMENT DEVICE

CROSS REFERENCES TO RELATED APPLICATIONS

This application claims benefit of priority of U.S. App. No. 62/637,241, filed Mar. 1, 2018, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to strength training employing a pair of straps each having an anchor on one end and a hand/foot hold on the other end.

Exercise devices evolving from gymnastics rings and similar rope exercise devices are widely used for strength training. The anchor ends of the device's straps are usually placed above the person performing the exercises, on an exercise bar, a tree limb, or between a door and a door frame. Exercises are then performed using the weight of the body. While the user holds the strap grips only a portion of the weight of the user's body is lifted by keeping the feet or hands on the ground or other support, and moving the user's body toward or away from the vertical plane. By adjusting the length of the straps the angle of the body with respect to the vertical plane is adjusted and thus the strength required for the movement of the body with respect to the vertical plane is also changed. This single exercise apparatus, itself compact and lightweight and thus easily stored and transported, can thus replace an entire set of exercise weights. To change the exercise intensity or to work different muscles it can often be necessary to change the length of the straps during exercise and many devices are known for adjusting the length of a webbing or other straps.

However, prior art mechanisms are such that it is not easy or intuitive to determine how to operate the mechanism so that the strap or webbing can be adjusted as required between exercises. Further, prior art mechanisms can require two hands or the manipulation of a small lever or button which may require some force. The end result is that the strap cannot be kept under some tension during adjustment and so it is not clear, as the adjustment is made, if the result of the manipulation of the strap adjusting mechanism will be the desired one. Typically, in adjusting the straps, the intent is to change the length of two straps by the same amount or to the same length. Thus, adjusting the straps involves using one hand on the grip to keep the strap under at least enough tension so the strap length under tension can be observed, and using the other hand to lengthen or shorten the strap. With the prior art devices this can be difficult to do which leads to repeated and aggravating efforts to accomplish the length adjustments of both straps. What is needed is a simple and intuitive mechanism for adjusting the length of both straps of a strength trainer.

SUMMARY OF THE INVENTION

The strength trainer of the invention has a first closed loop of webbing which is attached to a handle. The first closed loop extends around one side of a closed rectangular ring which forms part of a strap adjustment mechanism. The closed rectangular ring has four sides, one opposite the first member and two parallel sides which join the first member and the opposite side. The strength trainer of the invention has a second length of webbing which has one free end attached to an anchor and a second free end which is wrapped around a second member which is mounted between the two parallel sides of the closed rectangular ring and retained on the closed rectangular ring so as to allow some movement of the ring with respect to and along two parallel sides between the first member and the opposite side. The adjustment mechanism has a rigid housing which wraps the opposite side and the two parallel sides and at least part of the first side such that the closed rectangular ring is retained in the housing but can move within the housing toward or away from the part of the housing that wraps the opposite side of the rectangular ring. Two springs which form part of the adjustment mechanism are mounted between the opposite side and the housing so as to bias the rectangular ring toward the part of the housing which wraps the first side. The opposite side of the rectangular ring has a surface facing into the inside of the ring and has a first aggressive surface which faces the second member. The second member has a second aggressive surface facing the first aggressive surface and a third aggressive surface on a side opposite the second aggressive surface. The second length of webbing extends from the anchor and passes through the closed rectangular ring and is wrapped around the third aggressive surface and passes between the first aggressive surface and the second aggressive surface.

The strap adjustment mechanism thus configured employs in part the principle embodied in a capstan about which a rope is wound, by which a person is allowed to hold one end of the rope to resist the movement of a large boat. The clamping force produced by the springs in the housing closes the first aggressive surface and the second aggressive surface against the second web strap, but is easily overcome to make an adjustment in the strap length pulling on the strap. However, under load the second strap wraps the second member over the third aggressive surface to an angle of about 270° which amplifies the spring and increases hold force by $e^{\mu\varphi}$ where $\mu$ is the coefficient of friction and $\varphi$ is the total angle of wrap measured in radians. Thus, the hold force is increased by the friction of the third aggressive surface and the wrap angle $\varphi$ measured in radians. When the second strap is under load i.e., the strength trainer is supporting a person's weight, the tension in the second strap forces the first and second aggressive surfaces together with a force much greater than the force provided by the springs in the housing.

Further objects, features and advantages of the invention will be apparent from the following detailed description when taken in conjunction with the accompanying drawings.

DESCRIPTION OF THE PREFERRED EMBODIMENTS

Figures 4, 5:
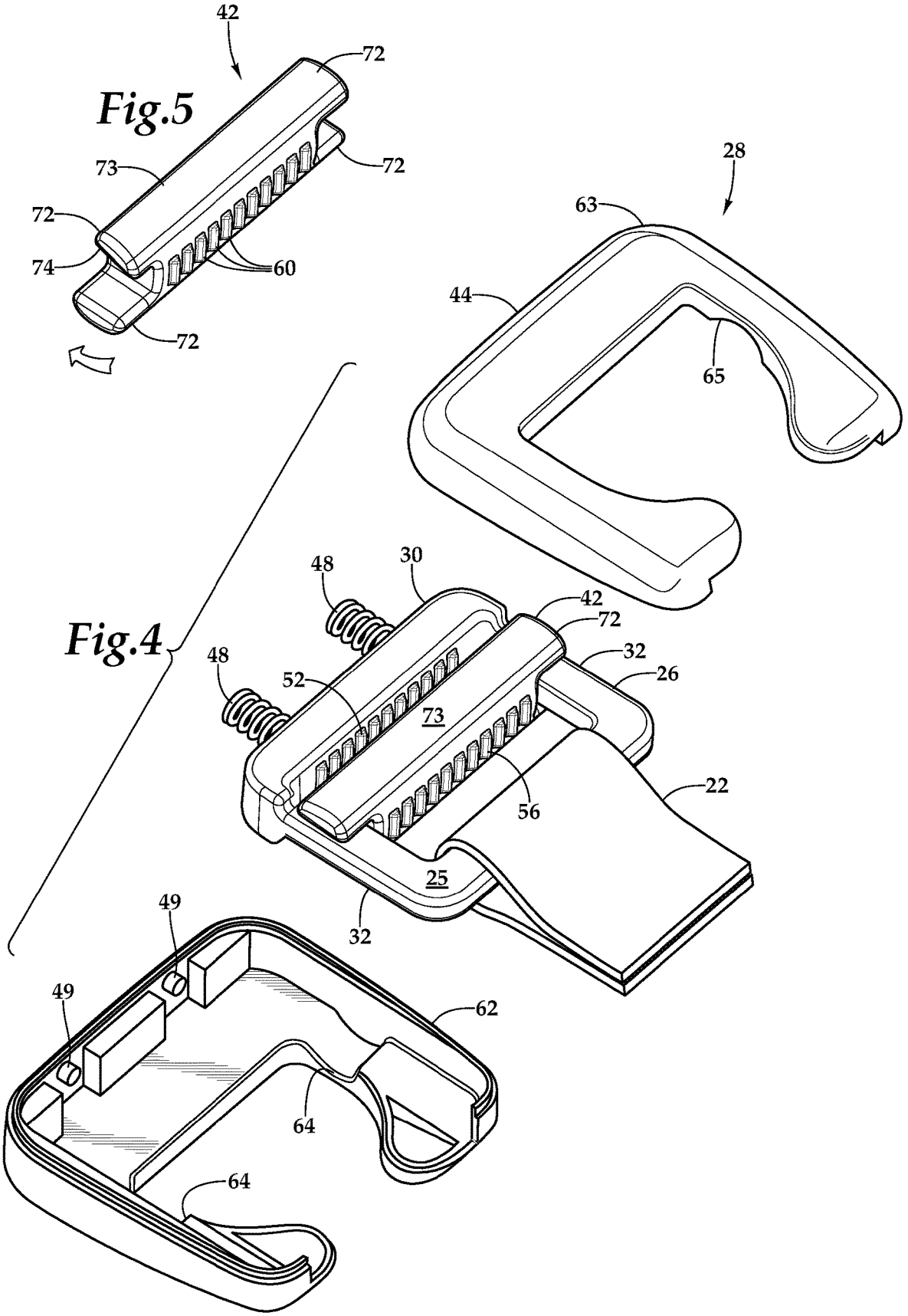
FIG. 4 is an exploded isometric view of the strap adjustment mechanism of FIG. 1. For clarity, stiffening ribbing in the housing has been omitted from this view.
FIG. 5 is an isometric view of a second member which forms a part of the strap adjustment mechanism of FIG. 4, rotated 180 degrees about its longitudinal axis from its position in FIG. 4.
Figure 6:
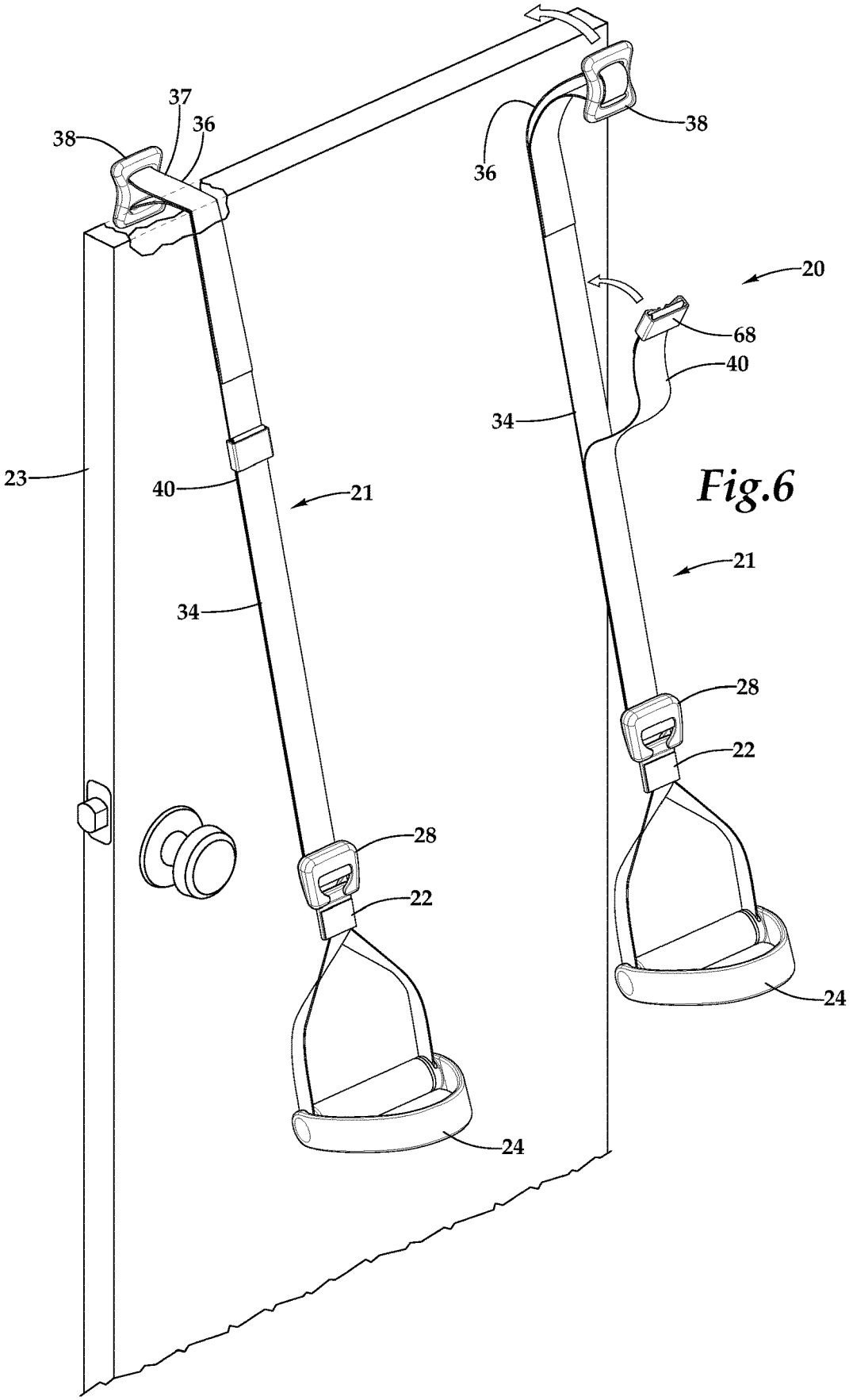
FIG. 6 is an isometric view of a strength trainer of this invention including the strap adjustment mechanism of FIG. 1 shown mounted with respect to a door.

Referring more particularly to FIGS. 1-6, wherein like numbers refer to similar parts, a strength trainer 20 is shown in FIG. 6. The strength trainer 20 has two adjustable strap assemblies 21, each with a handle 24 at one end which serves as a grip which the user holds, and an anchor 38 at the other end which is secured to some fixed position such as between a door 23 and a door frame (not shown). Each strap assembly handle 24 is attached to a first closed loop of webbing 22. Each anchor 38 is connected to a length of webbing defining a second strap 34. The anchor second strap 34 and the first closed loop of webbing 22 are adjustably connected by a strap adjustment mechanism 28.

Figure 2:
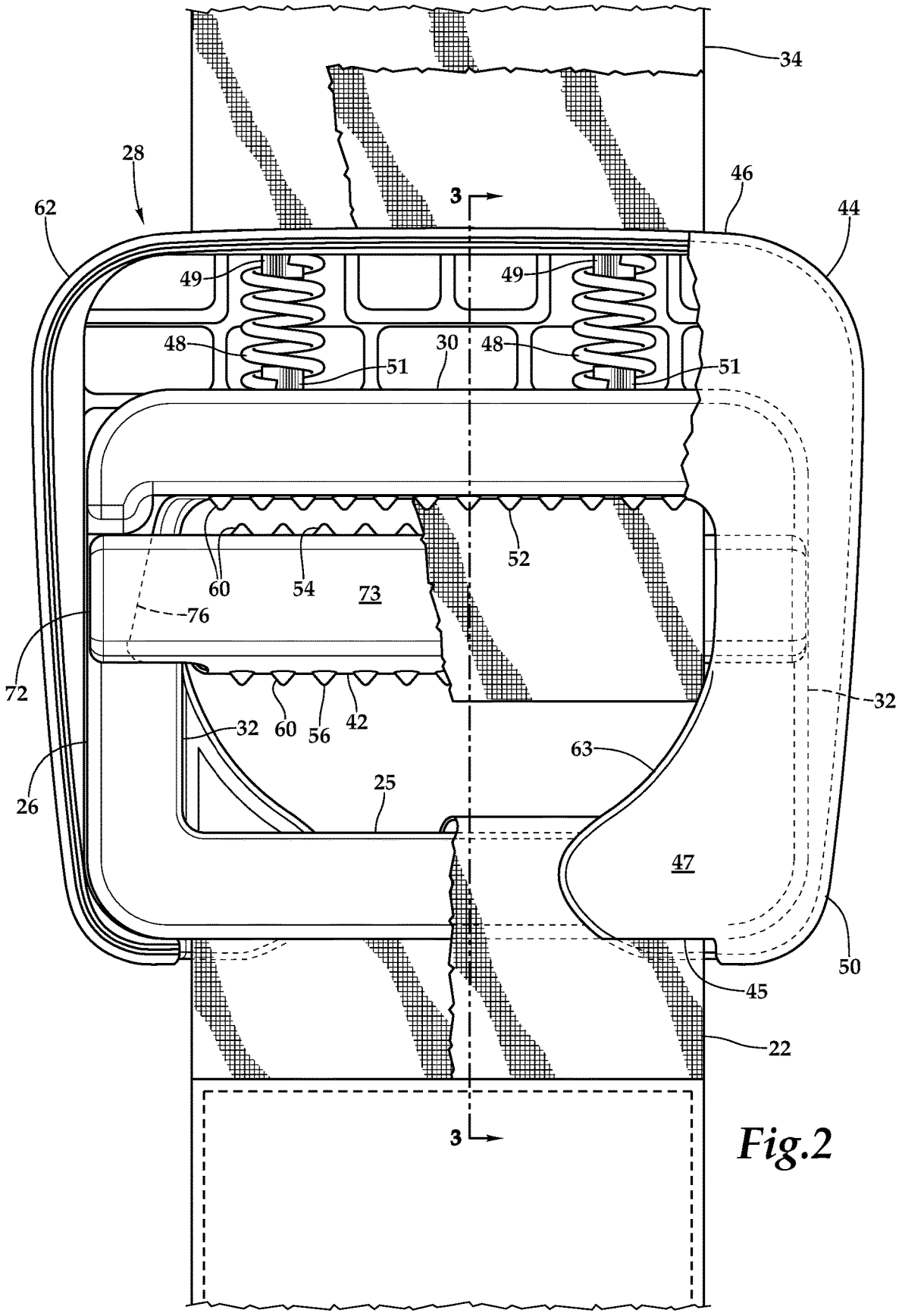
FIG. 2 is a front elevational view of the strap adjustment mechanism of FIG. 1, partially cut away.

The strap adjustment mechanism, as shown in FIG. 4 has a plastic rigid housing 44 comprised of front and rear parts 63, 62 which encloses a closed rectangular ring 26 with an internal cross piece or second member 42. As shown in FIG. 2, the ring 26 has four side members: a bottom or first member 25, and a top or opposite member 30 opposite the first member 25 and two parallel side members 32 which join the first member 25 and the opposite member 30.

The first closed loop of webbing 22 extends around the ring first member 25. The anchor webbing strap 34 has a first free end 36 which is terminated by a closed loop 37 attached to the anchor 38, and a second free end 40 which extends through the adjustment mechanism 28 wrapping around the cross piece second member 42 and is then clipped to the second strap 34 by a clip 68 as shown in FIG. 6.

The cross piece second member 42 as shown in FIG. 5 is mounted between the two parallel side members 32 of the closed rectangular ring 26 as shown in FIG. 4. The second member 42 is retained on the closed rectangular ring 26 and mounted for some movement of the second member with respect to the rectangular ring along the two parallel sides 32. The housing 44 extends around portions of the ring 26 and wraps the opposite member 30, the two parallel side members 32 and at least part of the first member 25 such that the ring 26 is retained within the housing and can move within the housing toward or away from the top part 46 of the housing 44 that wraps the opposite member 30 of the ring 26.

The adjustment mechanism 28 has two coil springs 48 which are mounted to extend between the opposite member 30 and the housing 44 to bias the rectangular ring 26 toward a lower part 50 of the housing which wraps the first member 25. The rear part 62 of the housing 44 has two spring mounting projections 49 which engage the two coil springs 48. The opposite member 30 has two opposed spring mounting projections 51 which engage the other ends of the coil springs 48.

Figure 3:
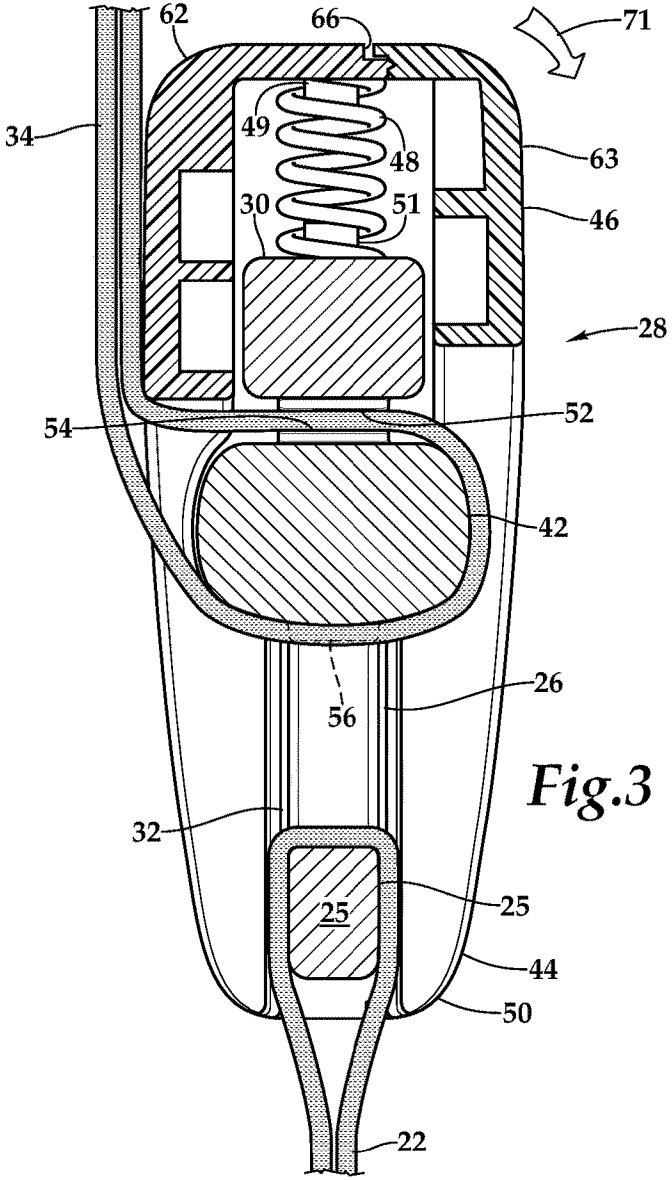
FIG. 3 is a cross-sectional view of the strap adjustment mechanism of FIG. 1 shown in the loading support position, and taken along section line 3-3 in FIG. 2.
Figure 1:
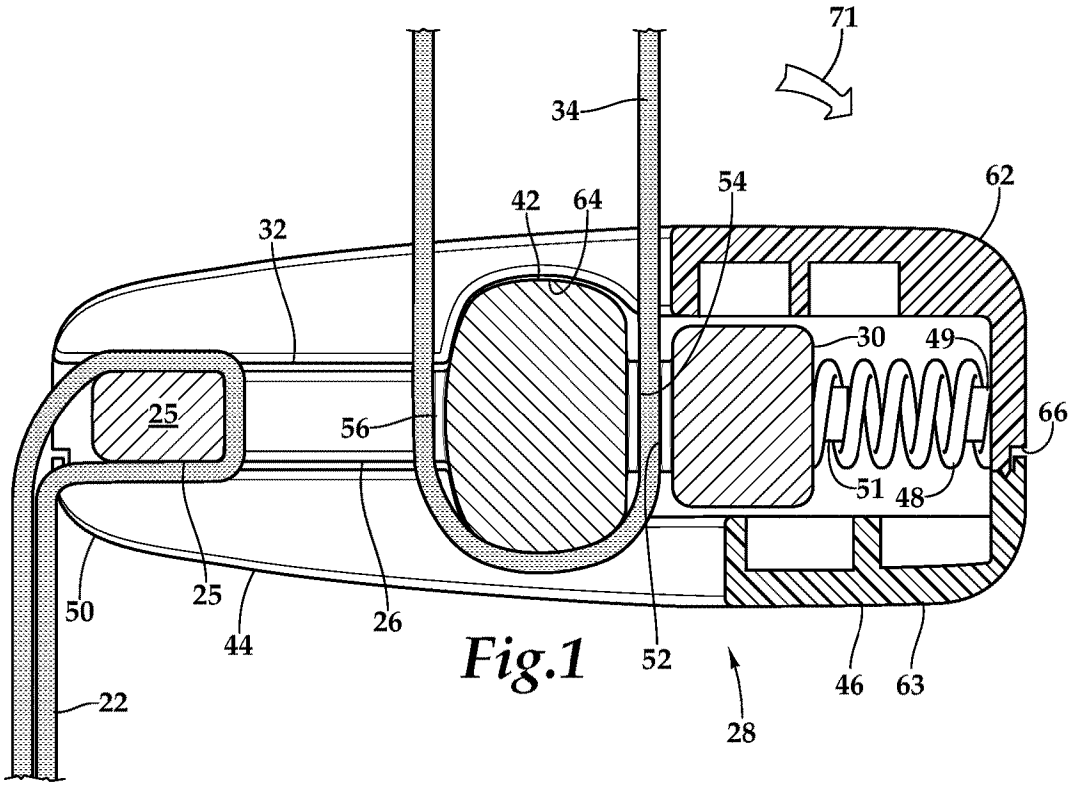
FIG. 1 is a cross-sectional view of the strap adjustment mechanism of this invention shown in the adjustment position.

The opposite member 30 of the ring 26 has an internal surface facing the inside of the rectangular ring which forms a first aggressive surface 52 which faces the second member 42. As shown in FIGS. 1 and 3, the second member 42 is thicker than the ring, hence it is retained with respect to the housing by engaging within concave depressions 65 in the front part 63 of the housing and concave depressions 64 in the rear part 62 of the housing. As shown in FIG. 4, the rear part 62 concave depressions 64 and front part 63 depressions 65 fixedly retain the second member 42 with respect to the housing. The second member 42 is free to travel on the side members 32 of the ring, and the housing is fixed with respect to the second member. As shown in FIG. 2, the bottom portion of the housing defines a gap 45 below the first member 25 of the ring through which a strap may extend.

As shown in FIG. 1, the front part 63 of the housing is joined to the rear part 62 along a bonding surface 66. The front part 63 of the housing is substantially the same as the rear part 62 except it does not provide for mounting the springs 48 and therefore has a diminished depth. The housing 44 has a bottom portion 47 spaced below the top portion 46 which encloses a portion of the first member 25. The second member 42 has a second aggressive surface 54 facing the first aggressive surface 52 and a third aggressive surface 56 on a side opposite the second aggressive surface. The second length of webbing 34 extends from the anchor 38 and passes through the closed rectangular ring 26 and wraps around the third aggressive surface 56 and passes between the first aggressive surface 52 and the second aggressive surface 54 as shown in FIGS. 1-3. As shown in FIG. 3, when the first loop of webbing 22 transmits a load through the strap adjustment mechanism 28 to the second length of webbing 34 which applies the load to the anchor 38, the second length of webbing is under tension. Tension in the webbings 22, 34 loads the rectangular ring 26 against the second member 42. This in turn clamps the webbing 34 between the aggressive surfaces 52 and 54.

To adjust the second length of webbing 34 the strap adjustment mechanism is rotated downwardly about 30-90 degrees usually toward the person using the strength trainer as indicated by arrow 71 shown in FIGS. 1 and 3. The adjustment can be done one handed allowing the user to keep a hand on the handle 24 to apply tension to extend the distance between the anchor 38 and the handle or to pull on the second free end 40 to shorten the distance between the anchor 38 and the handle.

To allow assembly of the rectangular ring 26 and the second member 24, the second member may be formed with four flanges 72 which protrude longitudinally from the body 73 of the second member, as shown in FIG. 5. The flanges 72 extend along the front and rear surfaces of the rectangular ring 26. The flanges 72 thus support the second member as it moves with respect to the rectangular ring. A shorter flange 74 is terminated at an angle 74 to match an angled cutout 76 in the inside of the ring as shown in FIG. 2. By tilting the second member 24, the shorter angled flange 74 can pass through the angled cutout 76 in the ring 26, to thereby be installed into its functioning position.

It should be noted that the strap adjustment mechanism 28 does not depend on the housing 44 to support the tension load through the adjustment mechanism.

It should be understood that an aggressive surface means a high friction surface, which for example, has protrusions 60 as shown in FIGS. 2 and 5 but includes any surface which has a level of roughness or friction so that the friction under load between the webbing 34 and the surfaces 52, 54, 56 prevent movement of the webbing 34 with respect to the strap adjustment mechanism 28.

It should be understood that web or webbing or strap refers to strong (e.g., supports loads of hundreds to thousands of pounds) closely woven fabric which has a length which is at least a few times to hundreds of times longer than the width, and a thickness which is less than approximately one tenth of the width.

It is understood that the invention is not limited to the particular construction and arrangement of parts herein illustrated and described, but embraces all such modified forms thereof as come within the scope of the following claims.

We claim:

1. An adjustable strap assembly comprising: a housing; a cross member fixed with respect to the housing; a ring mounted to the cross member for sliding movement within the housing, wherein the ring has a bottom member, a top member, and two parallel side members which extend between the top member and the bottom member, the cross member being positioned between the top member and the bottom member of the ring, and having portions which engage the ring in sliding movement along the two parallel side members; a first strap secured to the bottom member of the ring and extending out of the housing; a second strap which extends from outside of the housing and between the top member of the ring and the cross member, wraps around the cross member and extends between the cross member and the bottom member of the ring out of the housing; and at least one spring which extends between the housing and the ring to bias the ring in a first direction which extends between the top member of the ring and the bottom member of the ring.

2. The adjustable strap assembly of claim 1 wherein the two parallel side members of the ring each have a front surface and a rear surface, and wherein the portions of the cross member which engage the two parallel side members comprise four flanges which extend in a direction perpendicular to the first direction to extend over the two parallel side members of the ring along the front surface and the rear surface.

3. The adjustable strap assembly of claim 2 wherein one of the four flanges of the cross member is cut shorter than the others at an angle to match an angled cut-out in the inside of the ring, such that the ring is configured to be assembled to the cross member by tilting the cross member so the shorter flange is configured to pass through the angled cut-out in the ring.

4. The adjustable strap assembly of claim 1 further comprising: a mounting projection within the housing which extends from the housing in the first direction towards the ring; a mounting projection on the ring which extends towards the mounting projection of the housing, wherein the at least one spring is engaged between the mounting projection of the housing and the mounting projection of the ring.

5. The adjustable strap assembly of claim 1 wherein the housing comprises: a front part having a concave depression; and a rear part fixed to the front part and having a concave depression which faces the concave depression of the front part, wherein the cross member is received within the concave depressions of the front and rear parts, and is thereby fixed with respect to the housing.

6. The adjustable strap assembly of claim 1 wherein the housing has a bottom portion which encloses a portion of the bottom member of the ring.

7. The adjustable strap assembly of claim 1 further comprising: portions of the top member of the ring which define an aggressive surface facing the cross member; portions of the cross member which define an aggressive surface facing the top member of the ring; and portions of the cross member which define an aggressive surface facing the bottom member of the ring.

8. A strap adjustment mechanism, comprising: a housing: a rectangular ring mounted to the housing for sliding movement within the housing, wherein the rectangular ring has a bottom member, a top member, and two parallel side members which extend between the top member and the bottom member, the two parallel side members having a front surface and a rear surface; at least one spring mounted between the top member of the rectangular ring and the housing; a cross member fixedly mounted to the housing and mounted to the rectangular ring and extending between the two parallel side members of the rectangular ring, the cross member having portions which at least partially overlie the front and rear surfaces of each of the two parallel side members of the rectangular ring, so that the at least one spring biases the rectangular ring to move between said portions toward a bottom portion of the housing; wherein the cross member has a first side with a first aggressive surface that faces the top member of the rectangular ring, and wherein the top member of the rectangular ring has a second aggressive surface which faces the first aggressive surface of the cross member; and wherein the cross member has a second side with a third aggressive surface that faces the bottom member of the rectangular ring.

9. The strap adjustment mechanism of claim 8 wherein the bottom portion of the housing encloses a portion of the bottom member of the rectangular ring, and wherein the bottom portion of the housing defines a gap below the bottom member of the rectangular ring through which a strap is configured to extend.

10. The strap adjustment mechanism of claim 8 wherein the first aggressive surface, the second aggressive surface, and the third aggressive surface have a multiplicity of protrusions which render said first, second and third aggressive surfaces resistant to the movement of a webbing or strap across said first, second and third aggressive surfaces.

11. The strap adjustment mechanism of claim 8 wherein the portions of the cross member which at least partially overlie the front and rear surfaces of the side members of the rectangular ring comprise four flanges, and wherein one of the four flanges of the cross member is cut shorter than the others at an angle to match an angled cut-out in the inside of the rectangular ring, such that the rectangular ring is configured to be assembled to the cross member by tilting the cross member so the shorter flange is configured to pass through the angled cut-out in the rectangular ring.

12. The strap adjustment mechanism of claim 8 further comprising: a mounting projection within the housing which extends from the housing in the first direction towards the rectangular ring; and a mounting projection on the rectangular ring which extends towards the mounting projection of the housing, wherein the at least one spring k engaged between the mounting projection of the housing and the mounting projection of the rectangular ring.

13. The strap adjustment mechanism of claim 8 wherein the housing comprises: a front part having a concave depression; and a rear part fixed to the front part and having a concave depression which faces the concave depression of the front part, wherein the cross member k received within the concave depressions of the front part and the rear part, and k thereby fixed to the housing.

14. A strength trainer comprising: a strap adjustment mechanism, comprising: a housing having a top portion and a bottom portion spaced beneath the top portion: a rectangular ring mounted to the housing for sliding movement within the housing; wherein the rectangular ring is formed by a bottom member, a top member, and two parallel side members extending between the top member and the bottom member, the two parallel side members each having a front surface and a rear surface; at least one spring mounted between the top member of the rectangular ring and the top portion of the housing; a cross member fixedly mounted to the housing and extending between the two parallel side members of the rectangular ring, and having portions which at least partially overlie the front and rear surfaces of each of the two parallel side members of the rectangular ring, so that the at least one spring biases the rectangular ring to move between said portions toward the bottom portion of the housing; further comprising: a first strap attached to a handle and to the bottom member of the rectangular ring; a second strap having portions attached to an anchor and portions threaded through the strap adjustment mechanism so the second strap passes first through the rectangular ring between the bottom member and the cross member and wraps around the cross member and then passes through the rectangular ring between the cross member and the top member of the rectangular ring.

15. The strength trainer of claim 14 further comprising: portions of the top member of the rectangular ring which define an aggressive surface facing the cross member; portions of the cross member which define an aggressive surface facing the top member of the rectangular ring; and portions of the cross member which define an aggressive surface facing the bottom member of the rectangular ring.

16. The strength trainer of claim 15 wherein the aggressive surfaces have a multiplicity of protrusions which render said aggressive surfaces resistant to the movement of said first and second straps across said aggressive surfaces.

17. The strength trainer of claim 14 wherein the bottom portion of the housing encloses a portion of the bottom member of the rectangular ring, and wherein the bottom portion of the housing defines a gap below the bottom member of the rectangular ring through which the first strap extends.

18. The strength trainer of claim 14 wherein the portions of the cross member which at least partially overlie the front and rear surfaces of the two parallel side members of the rectangular ring comprise four flanges, and wherein one of the four flanges of the cross member is cut shorter than the others at an angle to match an angled cut-out in the inside of the rectangular ring, such that the rectangular ring is configured to be assembled to the cross member by tilting the cross member so the shorter flange is configured to pass through the angled cut-out in the rectangular ring.

19. The strength trainer of claim 14 further comprising: a mounting projection within the housing which extends from the top portion of the housing towards the rectangular ring; a mounting projection on the rectangular ring which extends towards the mounting projection of the housing, wherein the at least one spring is engaged between the mounting projection of the housing and the mounting projection of the ring.

20. The strength trainer of claim 14 wherein the housing comprises: a front part having a concave depression; and a rear part fixed to the front part and having a concave depression which faces the concave depression of the front part, wherein the cross member is received within the concave depressions of the front and rear parts, and is thereby fixed to the housing.

* * * * *